United States Patent [19]

Makiol

[11] Patent Number: 4,834,453

[45] Date of Patent: May 30, 1989

[54] SWIVEL CHAIR

[75] Inventor: Fritz Makiol, Bützberg, Switzerland

[73] Assignee: Girsberger Holding AG, Bützberg, Switzerland

[21] Appl. No.: 92,325

[22] Filed: Sep. 2, 1987

[30] Foreign Application Priority Data

Sep. 8, 1986 [DE] Fed. Rep. of Germany ..... 3630503

[51] Int. Cl.[4] ..... A47C 3/00

[52] U.S. Cl. ..... 297/301; 297/354; 297/355; 297/DIG. 2

[58] Field of Search ..... 297/301, 300, 316, 323, 297/349, 354, 355, DIG. 2

[56] References Cited

U.S. PATENT DOCUMENTS 3,904,243 9/1975 Kostelec et al. ..... 297/DIG. 2
4,560,199 12/1985 Sapper ..... 297/301 X
4,585,272 4/1986 Ballarini ..... 297/300 X
4,709,963 12/1987 Uecker ..... 297/316

*Primary Examiner*—James T. McCall
*Attorney, Agent, or Firm*—Peter K. Kontler

[57] ABSTRACT

A swivel chair has a leg with a support at the upper end of its upright column and two shells which are articulately connected to each other and at least one of which is articulately connected directly to the support. The one shell carries a cushion and forms therewith the seat of the chair. The other shell is assembled of two sections which are pivotable relative to each other about a horizontal axis, one of which supports the lumbar region of the body of the occupant of the chair and the other of which serves as a shoulder support. The one section is articulately connected to the rear portion of the one shell by two hinges.

18 Claims, 4 Drawing Sheets

SWIVEL CHAIR

CROSS-REFERENCE TO RELATED APPLICATION

The swivel chair of the present invention is similar to the chair which is disclosed in the commonly owned copending patent application Ser. No. 092,328 filed Sept. 2, 1987 by Felix Stucki for "Swivel chair with adjustable back rest".

BACKGROUND OF THE INVENTION

The invention relates to chairs in general, and more particularly to improvements in swivel chairs, for example, of the type disclosed in commonly owned U.S. Pat. No. 4,603,905 granted Aug. 5, 1986 to Felix Stucki for "Control mechanism for an adjustable chair or the like".

It is known to provide an office chair, particularly a swivel chair, with an adjustable seat and with a back rest which is articulately connected to a frame on top of a support of the leg of the chair. As a rule, the seat and the back support are provided with cushions which overlie suitably configurated shells and are or can be articulately connected to each other. The chair is provided with a discrete frame which is mounted on the support and is connected with the seat and back rest. The purpose of the frame is to transmit forces between the support on the one hand and the seat and back support on the other hand, especially to transmit forces which develop when the chair is occupied by a person. A drawback of the frame is that it contributes to the cost and bulk of the chair as well as that is detracts from the appearance of the chair. Moreover, the provision of a frame contributes to complexity of the adjusting mechanism which is normally provided to bring about changes in the positions of the seat and/or back rest relative to the support and/or relative to each other.

A typical discrete frame on top of the support of the leg is disclosed, for example, in German Offenlegungsschrift No. 29 25 520. The frame is directly affixed to the underside of the seat and is pivotally connected to the frame members of the back rest. The frame and other parts of the chair which is disclosed in this publication take up a substantial amount of space beneath the seat as well as behind the back rest. This detracts from the appearance of the chair.

German Utility Model No. 77 21 954 discloses a modified swivel chair wherein the support at the upper end of the upright column of the leg carries a discrete frame having a first part which is articulately connected to the front portion of the seat and a second part which is articulately connected to the rear portion of the seat. The rear portion of the seat is rigidly or movably connected with a one-piece back rest. The parts beneath the two-piece seat occupy a substantial amount of space and detract from the appearance of the chair.

A further conventional swivel chair is disclosed in German Utility Model No. 84 17 429. The back rest of this chair is located in front of a large frame which carries an adjusting mechanism for the back rest, and such frame is further coupled to a frame at the underside of the seat. The two frames are mounted on a further frame on top of the upright column of the leg. This chair exhibits the drawbacks of the aforediscussed conventional chairs.

OBJECTS AND SUMMARY OF THE INVENTION

An object of the invention is to provide a novel and improved chair wherein at least a substantial part of a conventional frame can be omitted so that the chair can have an eye-pleasing streamlined outline.

Another object of the invention is to provide a relatively simple, compact and inexpensive chair which can be used in offices or homes as a superior substitute for conventional chairs and wherein the total or nearly complete absence of a full-sized frame does not detract from the stability, versatility and/or other desirable characteristics.

A further object of the invention is to provide a chair wherein the rigid parts of the seat and back rest are connected to each other in a novel way and wherein the bulk of the seat and/or back rest is a fraction of the bulk of such parts in conventional chairs.

An additional object of the invention is to provide a novel and improved connection between the seat and back rest of a swivel chair on the one hand and the leg of such chair on the other hand.

Still another object of the invention is to provide a swivel chair wherein the rigid parts of the back rest and/or seat can be mounted directly on the leg.

A further object of the invention is to provide a novel and improved seat and a novel and improved back rest for use in a chair of the above outlined character.

The improved chair is preferably a swivel chair and comprises a leg having a support, a seat having a first skeleton frame or shell, means for movably connecting the skeleton frame directly to the support, a back rest having a second skeleton frame or shell, and means for movably coupling the second skeleton frame to the first skeleton frame. Means can be provided for movably connecting the second skeleton frame directly to the support. The support can include first and second carrier portions, and the connecting means can include a hinge which pivotably mounts the first skeleton frame on the first carrier portion. The second skeleton frame can be rigid with the second carrier portion, and such chair can further comprise means for movably securing the carrier portions to each other. The securing means can comprise a joint which enables the carrier portion to perform translatory as well as angular movements relative to each other.

Each skeleton frame comprises two lateral portions and each lateral portion of one of the skeleton frames is adjacent one lateral portion of the other skeleton frame. The coupling means can comprise two hinge joints each of which connects a lateral portion of one frame with the respective lateral portion of the other frame. Furthermore, the skeleton frames can be provided with neighboring complementary male and female portions which can be disposed between the hinge joints of the coupling means.

At least one of the skeleton frames can comprise reinforcing portions in the form of ribs, webs or like parts, and the chair preferably further comprises detachable cushions which overlie the skeleton frames and conceal the reinforcing means.

The second skeleton frame can comprise a lumbar section which is movably secured to the first skeleton frame by the coupling means, and a shoulder-supporting section. The second skeleton frame then further comprises means for movably fixing the lumbar and shoulder-supporting sections to each other. Such fixing means can define a substantially horizontal pivot axis, and the second skeleton frame preferably further comprises stop means for limiting the extent of pivotal movability of the two sections relative to each other as well as means for biasing one of the sections in a predetermined direction with reference to the other section. The sections are formed with lateral portions and the fixing means can include hinge joints which connect the lateral portions of one of the sections with the lateral portions of the other section. The stop means can be provided on or close to at least one of these hinge joints. The biasing means can be provided at the rear side(s) of the section(s).

Two arm rests can be provided, and such chair then further comprises means for connecting the arm rests to one of the sections in the region of the fixing means.

The first carrier portion of the support has a front end which can be articulately secured to the first skeleton frame by a hinge. Resilient means can operate between the first carrier portion and the first skeleton frame to induce angular movements of the first skeleton frame in one direction with reference to the first carrier portion. The resilient means can comprise at least one torsion spring.

At least one of the two skeleton frames can consist of or contain a reinforced plastic material, such as polypropylene reinforced by glass fibers which can form mats or other suitable accumulations of fibrous material.

First resilient means can be interposed between the support and the first skeleton frame to urge the first means in a predetermined direction, and second resilient means can be provided to operate between the skeleton frames so as to urge one of the frames in a predetermined direction with reference to the other frame. The second resilient means can include the aforementioned biasing means which operates between the lumbar section and the first skeleton frame.

The novel features which are considered as characteristic of the invention are set forth in particular in the appended claims. The improved chair itself, however, both as to its construction and the mode of using the same, together with additional features and advantages thereof, will be best understood upon perusal of the following detailed description of certain specific embodiments with reference to the accompanying drawing.

DESCRIPTION OF THE PREFERRED EMBODIMENTS

Figure 1:
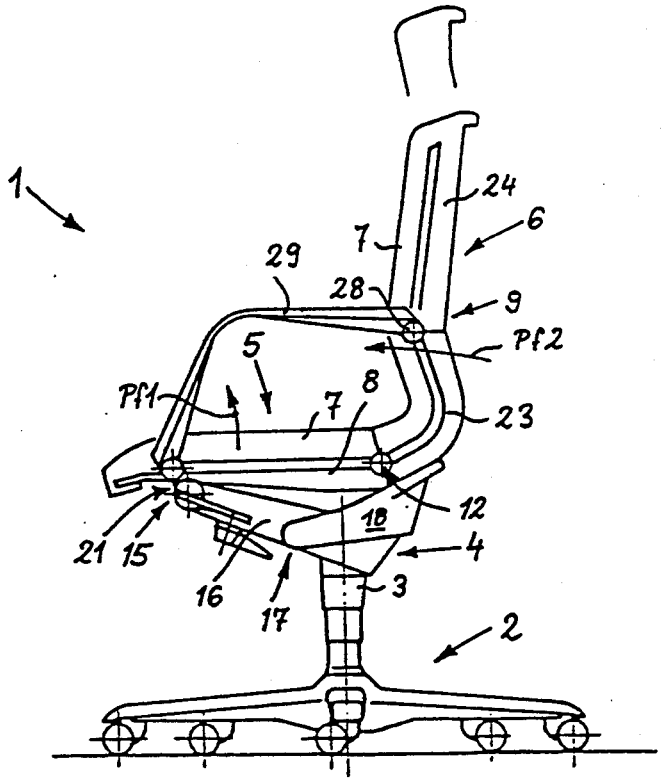
FIG. 1 is a schematic elevational view of a swivel chair which embodies one form of the invention.
Figure 2:
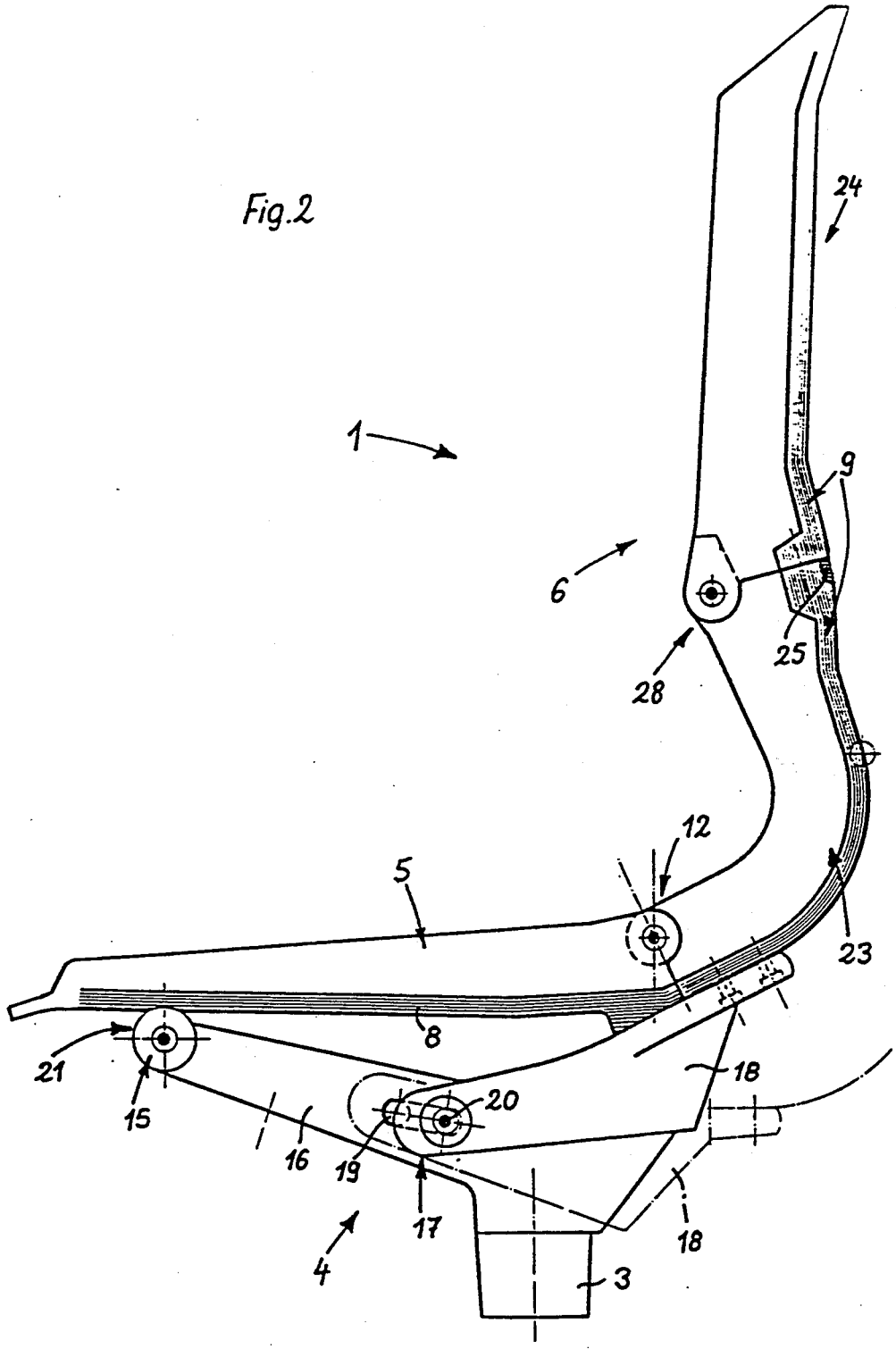
FIG. 2 is an enlarged view of the support and of the two skeleton frames.
Figure 3:
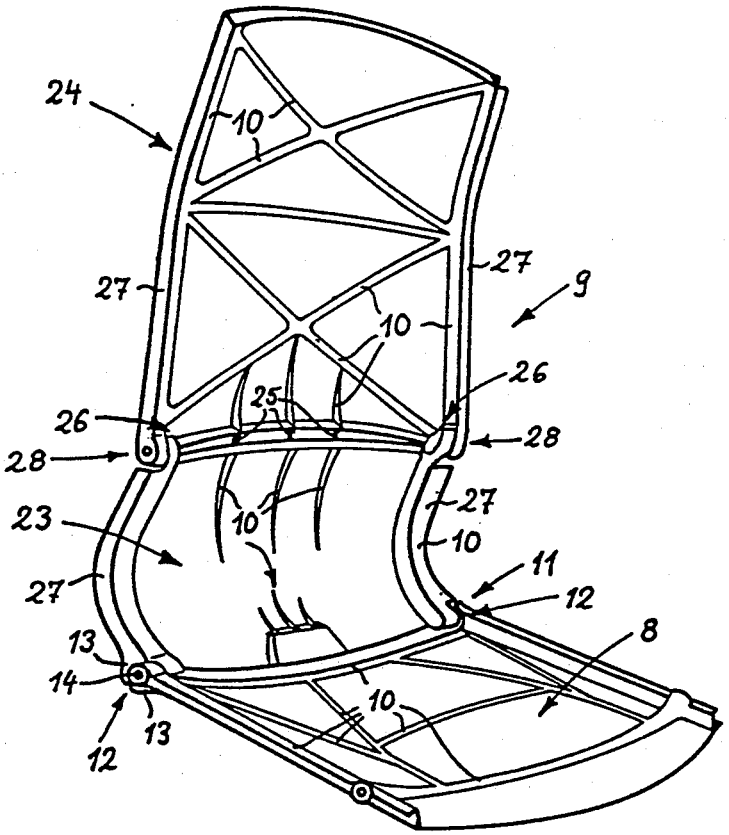
FIG. 3 is a perspective view of the skeleton frames.
Figure 4:
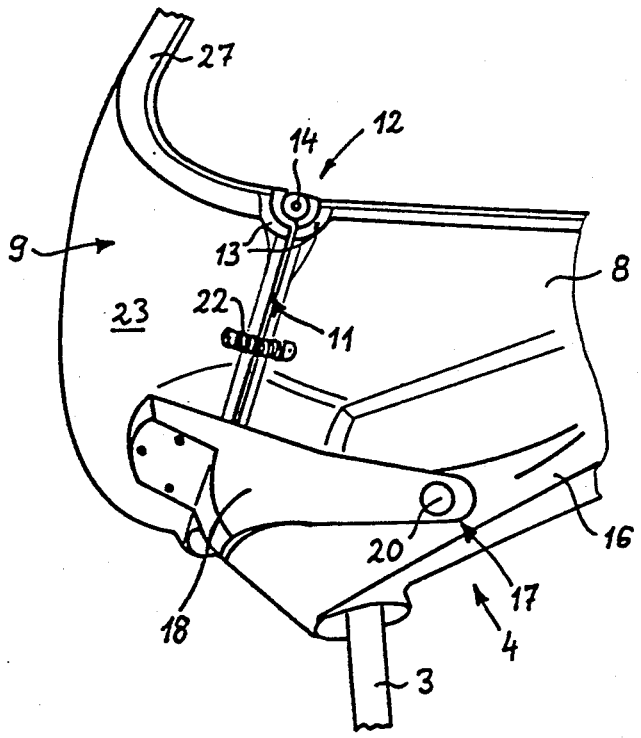
FIG. 4 is a fragmentary perspective bottom view of the skeleton frames and of the support.

FIG. 1 shows a swivel chair 1 which comprises a leg 2 including a floor-contacting portion with casters at the lower end of an upright tubular member 3 the upper end of which carries a support 4. In addition to the leg 2, the chair 1 comprises a seat 5 and a back support or back rest 6. The seat 5 includes a skeleton frame or shell 8 and a detachable cushion 7. The back rest 6 comprises a two-section shell or skeleton frame 9 and a detachable cushion 7. The skeleton frames 8 and 9 are best shown in FIG. 3. FIGS. 2 and 4 show the manner of connecting the skeleton frames 8, 9 to the support 4 of the leg 2 and the manner of coupling the skeleton frames to each other.

In accordance with a feature of the invention, the skeleton frames 8 and 9 are movably connected directly to the support 4 of the leg 2 so that the customary and bulky frame at the top of the support of the leg can be omitted in its entirety. This contributes to sleekness, simplicity and eye-pleasing appearance of the chair 1. It can be said that the skeleton frames 8, 9 of the seat 5 and back rest 6 jointly form a frame or understructure which performs the dual function of leading the necessary rigidity to the seat and to the back rest as well as of directly supporting the respective cushions 7. As can be seen in the drawing, the skeleton frames 8 and 9 include portions of concavo-convex shape to enhance their stability and hence their resistance to deformation. Additional stability is achieved by the provision of reinforcing means 10 in the form of ribs, webs and/or otherwise shaped projections which are distributed along the major part of each of the skeleton frames 8 and 9. The exact distribution of reinforcing means 10 is optional, as long as they can ensure that the seat 5 and the back rest 6 can carry the weight of the occupant without unduly increasing their bulk and weight. The renforcing means 10 are preferably provided at the front or inner sides of the respective skeleton frames 8 and 9 so that they are concealed by the corresponding cushions 7 when the chair 1 is in use. Such concealment of the reinforcing means 10 contributes to the eye-pleasing appearance of the chair.

The skeleton frame 8 has lateral portions 13 in the form of leaves 13 which are adjacent similar lateral portions 13 of the skeleton frame 9. The two pairs of lateral portions 13 and two pintles 14 jointly form two aligned hinge joints 12 which constitute a means for movably coupling the skeleton frames 8 and 9 to each other at the rear end of the seat 5. Those transversely extending portions 11 of the skeleton frames 8 and 9 which are disposed between the hinge joints 12 complement each other so as to form cooperating male and female portions which more or less seal the gap between the two frames. FIG. 4 shows that at least one of the portions 11 can be throat-shaped or grooved to receive the other portion and to avoid the development of a gap.

The support 4 of the leg 2 comprises a forwardly extending carrier portion 16 whose front end is articulately connected to the front portion of the skeleton frame 8 by a horizontal hinge 15. The rear end of the carrier portion 16 is rigid with the upper portion of the tubular member 3 of the leg 2. The support 4 further includes a second carrier portion 18 which extends rearwardly from the tubular member 3 and is rigid with the lower or lumbar section 23 of the skeleton frame 9 of the back rest 6. The means for movably securing the front end of the carrier portion 18 to the rear end of the carrier portion 16 comprises a joint 17 which enables the two carrier portions to perform translatory as well as angular movements relative to each other. As can be seen in FIG. 2, the joint 17 comprises a horizontal guide pin 20 which extends through an elongated slot 19 of the carrier portion 16 and is installed in the carrier portion 18. The means for releasably locking the guide pin 20 in a selected portion of the slot 19 (i.e., in a selected position of the carrier portion 18 with reference to the carrier portion 16 and/or vice versa) is not specifically shown in the drawing. Such locking means are well known in the art of swivel chairs. The purpose of the joint 17 is to ensure that an angular adjustment of the skeleton frame 9 forming part of the back rest 6 will entail a certain change in orientation of the skeleton frame 8 so as to ensure that the occupant of the chair 1 will be comfortable in each position of the carrier portions 16, 18 relative to each other. The drawing does not show the details of the adjusting mechanism which is used to raise or lower the seat 5 and the back rest 6, to change the inclination of the back rest 6 and/or to carry out other adjustments which are customary or required in a swivel chair. Reference may be had to the aforementioned commonly owned copending patent application and patent of Stucki.

The front end of the carrier portion 16 for the skeleton frame 8 carries at least one resilient element in the form of a torsion spring 21 which tends to turn the seat 5 in a counterclockwise direction (arrow Pf1 in FIG. 1) so as to raise the rear portion of the seat. The torsion spring 21 has a first leg which reacts against the carrier portion 16 and a second leg which bears against the seat 5 (skeleton frame 8) in order to tend to turn the seat counterclockwise about the pivot axis which is defined by the hinge 15. This spring is free to pivot the seat 5 in the direction of arrow Pf1 as soon as the locking mechanism of the adjusting means for the seat 5 and back rest 6 is released or disengaged. Any pivoting of the seat 5 in the direction of arrow Pf1 entails a certain amount of pivoting of the back rest 6 in the direction of an arrow Pf2 because the carrier portions 16, 18 for the skeleton frames 8, 9 are connected to each other by the aforediscussed joint 17.

The improved chair 1 further comprises biasing means which serves to assist the torsion spring 21 in urging the seat 5 in the direction of arrow Pf1. Such biasing means includes a set of coil springs 22 or any other suitable resilient elements which act between the skeleton frames 8, 9 and are preferably installed at the rear or outer sides of the skeleton frames. The chair 1 further comprises a casing (not specifically shown) which overlies the rear side of the skeleton frame 9 and the underside of the skeleton frame 8 to enhance the appearance fo the chair.

An advantage of the provision of springs 22 in addition to the torsion spring or springs 21 is that the means for biasing the skeleton frames 8, 9 in the directions which are indicated by arrows Pf1 and Pf2 need not include a relatively small number of bulky springs or a single large spring. The small springs 21, 22 can be readily concealed in the aforementioned casing and can be installed within the confines of a relatively small and compact adjusting mechanism.

In addition to the aforementioned lower or lumbar section 23, the skeleton frame 9 of the back rest 6 further includes an upper or shoulder-supporting section 24 which is articulately connected to the lumbar section 23 by two aligned horizontal hinge joints 28 which together constitute a means for movably fixing the sections 23, 24 to each other for movement about a pivot axis which is parallel to the common pivot axis of the hinge joints 12. Resilient elements in the form of coil springs 25 are provided to bias the shoulder-supporting section 24 forwardly so that, in the absence of adequate opposition to such pivoting, the lower parts of the two lateral or marginal portions 27 of the section 24 abut suitable stops 26 which are provided at the upper ends of the lateral or marginal portions 27 of the lumbar section 23. The springs 25 yield when the occupant of the chair 1 applies her or his shoulders and/or head against the cushion 9 of the back rest 6 in the region above the hinge joints 28 so that the section 24 can assume a position affording maximum comfort to the occupant. The springs 25 can be installed in suitable sockets (FIG. 2) which are provided therefor in the adjacent portion of portions of the section 23 and/or 24 intermediate the hinge joints 28. Such springs are located at the rear side of the skeleton frame 9 and are concealed by the aforementioned casing.

Two substantially L-shaped arm rests 29 are articulately connected to the skeleton frame 9 in the regions of the hinge joints 28. The front end portions of such arm rests abut the lateral portions of the skeleton frame 8 in the region of the hinge 15.

FIG. 3 shows that the width of the lumbar section 23 equals or approximates that the adjacent portion of the section 24 as well as that of the adjacent portion of the skeleton frame 8. Such dimensioning of the section 23 contributes to stability of the composite skeleton frame 8, 9 and of the entire chair. As mentioned above, the stability of the skeleton frames 8, 9 is also enhanced by the reinforcing means 10 as well as by the concavo-convex configuration of these frames. Such configuration renders it possible to employ surprisingly thin and lightweight skeleton frames without risking undesirable deformation of the chair and/or injury or discomfort to the occupant. It has been found that the skeleton frames 8, 9 can take up and transmit all forces which can reasonably be expected in normal use of the improved chair.

The skeleton frame 8 and the sections 23, 24 of the skeleton frame 9 are preferably made of a suitable synthetic thermoplastic material which is or can be reinforced. For example, the skeleton frames can be made of polypropylene which is reinforced by mats of or by otherwise distributed glass fibers. Polypropylene can be readily shaped in available machines so that each of the parts 8, 23, 24 can constitute a one-piece body.

An important advantage of the improved chair is that at least one of the skeleton frames 8, 9 (particularly the skeleton frame 8 of the seat 5) can replace the customary frame which is provided on top of the support of the leg in a conventional chair. This contributes to a reduction of the thickness and overall bulk of the chair in the region of the seat 5 as well as beneath the seat and in the region of the back rest 6. Moreover, the adjusting mechanism is more readily accessible than in conventional chairs wherein at least some parts of the adjusting mechanism for the level and/or other parameters of the seat and/or back rest must be or are installed in a discrete frame. The appearance of the chair is enhanced due to its slenderness (see particularly FIG. 1), and this is accomplished without unduly weakening and/or otherwise adversely affecting any parts of the chair including the adjusting mechanism. The improved chair can be produced at a reasonable cost and occupies little room in storage or in actual use. The adjustments are simple and in part automatic. Thus, and as described above, the torsion spring(s) 21 and the coil springs 22 cooperate to move the seat 5 and the back rest 6 to their starting positions as soon as the aforementioned locking means is released to enable the guide pin 20 of the rear carrier portion 18 to slide in the slot 19 of the front carrier portion 16. As mentioned above, this entails a simultaneous angular movement of the skeleton frames 8, 9 (arrows Pf1 and Pf2) so that the inclination of the skeleton frames 8, 9 relative to the carrier portion 16 and relative to each other is changed.

The subdivision of skeleton frames 9 into sections 23 and 24 is not absolutely necessary but is advisable and advantageous because this enables the occupant to find an optimum position for the corresponding parts of the body when the chair is in use. Furthermore, stresses which develop in actual use of the chair and are applied to the back rest 6 are divided between the sections 23 and 24.

The torsion spring or springs 21 can be replaced by or used jointly with other types of springs. Torsion springs are preferred at this time because they occupy little room so that their utilization contributes to compactness of the chair. The provision of additional springs (22) in the region between the hinge joints 12 also contributes to compactness of the chair because the springs 22 assist the torsion spring or springs 21 and thus allow for the utilization of smaller and compacter torsion springs.

Without further analysis, the foregoing will so fully reveal the gist of the present invention that others can, by applying current knowledge, readily adapt it for various applications without omitting features that, from the standpoint of prior art, fairly constitute essential characteristics to the art, and therefore, such adaptions should and are intended to be comprehended within the meaning and range of equivalence of the appended claims.

I claim:

1. A chair, particularly a swivel chair, comprising a leg having a support; a seat having a single one-piece first shell arranged to directly support a seat cushion; means for movably connecting said first single one-piece shell directly to said support; a back rest having a single second shell; means for movably coupling said shells to each other; and means for movably connecting said second shell directly to said support.

2. The chair of claim 1, wherein said support includes first and second carrier portions, said connecting means including a hinge pivotally mounting said first shell on said first carrier portion, said second shell being rigid with said second carrier portion and said connecting means comprising said second carrier portion and means for movably securing said carrier portions to each other.

3. The chair of claim 2, wherein said securing means includes a joint which enables said carrier portions to perform translatory and angular movements relative to each other.

4. The chair of claim 1, wherein each of said shells has two lateral portions and each lateral portion of one of said shells is adjacent one lateral portion of the other of said shells, said coupling means comprising two hinge joints each of which connects a lateral portion of said one shell with the respective lateral portion of said other shell.

5. The chair of claim 1, wherein said shells have neighboring complementary male and female portions.

6. The chair of claim 1, wherein at least one of said shells includes reinforcing portions and further comprising a cushion overlying the reinforcing portions of said one shell.

7. The chair of claim 1, wherein said second shell includes a lumbar section which is movably secured to said first shell by said coupling means, and a shoulder-supporting section, said second shell further comprising means for movably fixing said sections of each other.

8. A chair, particularly a swivel chair, comprising a leg having a support; a seat having a first shell; means for movably connecting said shell directly to said support; a back rest having a second shell; means for movably connecting said second shell directly to said support; and means for movably coupling said shells to each other, said second shell including a lumbar section which is movably secured to said first shell by said coupling means, and a shoulder-supporting section, said second shell further comprising means for movably fixing said sections to each other, said fixing means defining a substantially horizontal pivot axis and said second shell further comprising stop means for limiting the extent of pivotability of said sections relative to each other and means for biasing said sections in one direction.

9. A chair, particularly a swivel chair; comprising a leg having a support; a seat having a first shell; means for movably connecting said shell directly to said support; a back rest having a second shell; means for movably connecting said second shell directly to said support; means for movably coupling said shells to each other, said second shell including a lumbar section which is movably secured to said fist shell by said coupling means, and a shoulder-supporting section, said second shell further comprising means for movably fixing said sections to each other; two arm rests; and means for connecting said arm rests on one of said sections in the region of said fixing means.

10. A chair, particularly a swivel chair, comprising a leg having a support; a seat having a shell; means for movably connecting said shell directly to said support; a back rest having a second shell; means for movably coupling said shells to each other; means for movably connecting said second shell directly to said support, said support including a carrier portion for said first shell and said carrier portion including a front end, said connecting means comprising a hinge pivotally connecting said first shell to said front end; and resilient means interposed between said carrier portion and said first shell and operative to induce angular movements of said first shell in one direction with reference to said carrier portion.

11. A chair, particularly a swivel chair, comprising a leg having a support; a seat having a first shell; means for movably connecting said shell directly to said support; a back rest having a second shell, at least one of said shells containing a reinforced plastic material; means for movably coupling said shells to each other; and means for movably connecting said second shell directly to said support.

12. A chair, particularly a swivel chair, comprising a leg having a support; a seat having a first shell; means for movably connecting said shell directly to said support; a back rest having a second shell; means for movably coupling said shells to each other; means for movably connecting said second shell directly to said support; first resilient means interposed between said support and said first shell to urge said first shell in a predetermined direction; and second resilient means operating between said shells to urge one of said shells in a predetermined direction with reference to the other of said shells.

13. The chair of claim 8, wherein said sections have lateral portions and said fixing means includes hinge joints connecting the lateral portions of one of said sections with the lateral portion of the other of said sections.

14. The chair of claim 13, wherein said stop means is provided on or close to at least one of said hinge joints.

15. The chair of claim 13, wherein said sections have front and rear sides and said biasing means is provided at the rear sides of said sections.

16. The chair of claim 10, wherein said resilient means comprises at least one torsion spring.

17. The chair of claim 11, wherein the plastic material is polypropylene which is reinforced by glass fibers.

18. The chair of claim 12, wherein said second shell includes a lumbar section and a shoulder-supporting section, said resilient means being interposed between said first shell and said lumbar section.

* * * * *